US007399052B1

(12) United States Patent
Anderson et al.

(10) Patent No.: US 7,399,052 B1
(45) Date of Patent: Jul. 15, 2008

(54) RENOVATED INK JET CARTRIDGE AND METHOD OF RENOVATING

(76) Inventors: Stephen A. Anderson, 2563 Milton La., Thompsons Station, TN (US) 37179; Carl W. Holland, 95 Hefner Dr., Webster, NY (US) 14580; William F. Schumacher, 199 Thornell Rd., Pittsford, NY (US) 14534

( * ) Notice: Subject to any disclaimer, the term of this patent is extended or adjusted under 35 U.S.C. 154(b) by 310 days.

(21) Appl. No.: 11/089,855

(22) Filed: Mar. 25, 2005

(51) Int. Cl.
*B41J 2/15* (2006.01)
*B41J 2/175* (2006.01)

(52) U.S. Cl. ..... 347/20; 347/87

(58) Field of Classification Search ..... 347/47, 347/63, 64, 66, 87; 29/890.1
See application file for complete search history.

(56) References Cited

U.S. PATENT DOCUMENTS 5,388,326 A * 2/1995 Beeson et al. ..... 29/611
5,736,998 A * 4/1998 Caren et al. ..... 347/45
6,501,527 B1 * 12/2002 Hirose et al. ..... 349/155

* cited by examiner

*Primary Examiner*—Anh T. N. Vo
(74) *Attorney, Agent, or Firm*—Fay Sharpe LLP

(57) ABSTRACT

An ink jet cartridge comprising a housing having a print head portion including a nozzle plate having opposed pairs of side edges, rows of nozzles and at least one row of slots between said rows of nozzles and which plate is initially attached to the head portion by beads of an adhesive material overlying the edges of one pair of the opposed pairs of side edges is prepared for renovation by applying a reinforcing bead of an adhesive material to overlie at least one of the other pair of the opposed pairs of side edges and the at least one row of slots. The beads may be a single bead or segmented and are applied by robotic glue applying apparatus.

32 Claims, 9 Drawing Sheets

RENOVATED INK JET CARTRIDGE AND METHOD OF RENOVATING

BACKGROUND

This invention relates to the art of ink jet cartridges and, more particularly, to preparing a used ink jet cartridge for renovation to promote the extended life and reuse thereof.

It is known that the life of an ink jet cartridge can be extended beyond the time it takes to deplete the cartridge of its initial supply of ink. For example, refill kits are provided for replenishing a cartridge's ink supply, and continuous refill systems have been developed for providing a continuous flow of ink to a cartridge from a remotely located ink supply bag or the like. In connection with extending the life of a cartridge, the latter needs to be periodically cleaned or renovated to avoid the buildup of dried ink inside the cartridge and in areas such as the nozzle plate where the buildup can preclude or seriously impair quality printing. The renovating or cleaning process includes soaking the cartridge in a cleaning solution and then flushing the cartridge to force the cleaning fluid through the nozzles or jets in the nozzle plate. Further, a vacuum is pulled across the nozzle jets in the nozzle plate and the internal pressure and/or the vacuum create a force on the nozzle plate tending to lift it from the snout portion of the cartridge to which it is initially bonded during the manufacture of the cartridge. Still further, a centrifuge process is used to remove the cleaning fluid inside the cartridge by expulsion thereof through the nozzle jets, and this centrifugal force will also lift the nozzle plate from its attachment to the cartridge. If the cartridge is then refilled with ink and placed back into service, the loose nozzle plate can result in poor print quality, such as fuzzy print, and can result in cross-contamination of colors in a color printing cartridge. Furthermore, if a cartridge being renovated already has a loose nozzle plate, the renovating or remanufacturing process tends to further loosen or remove the plate. In any event, loose nozzle plates cause a considerable loss in the yield of reusable cartridges in connection with a renovating or remanufacturing process.

SUMMARY OF THE INVENTION

In accordance with the present invention, the attachment of a nozzle plate to an ink jet cartridge is reinforced prior to the renovating or remanufacturing process so as to reduce the occurrence of the plate being loose following the renovation process. More particularly in this respect, the nozzle plate of a cartridge which is adhesively bonded to the snout portion of a cartridge at the time of manufacture is provided with a supplemental bead or beads of an adhesive material to reinforce the attachment of the nozzle plate to the cartridge against loosening of the plate during renovation. The supplemental beads of adhesive material are applied in areas of the nozzle plate other than those in which the initial beads of adhesive are located. While the supplemental beads of adhesive can be applied by hand, it is preferred, in accordance with another aspect of the invention, to apply the adhesive through the use of programmable apparatus in that the latter provides optimal control of bead location and height as well as consistency with respect to these parameters which, in turn, promotes improved process efficiency and minimal material waste. Moreover, the supplemental beads of adhesive promote a higher yield of reusable cartridges at a reduced production cost.

It is accordingly an outstanding object of the present invention to provide an ink jet cartridge in which the attachment of the nozzle plate to the cartridge is reinforced prior to renovation or remanufacturing of the cartridge for continued use.

Another object is the provision of a method of reinforcing the original attachment of a nozzle plate to an ink jet cartridge by supplemental beads of an adhesive material.

Yet another object is the provision of apparatus for applying supplemental beads of an adhesive material to the nozzle plate of a used ink jet cartridge to provide consistency with respect to glue bead location and height.

Still another object is the provision of a method and apparatus for preparing a used ink jet cartridge for remanufacturing which provides improved efficiency with respect to the preparation, minimal material waste, reduced production costs and increased yield of reusable cartridges.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
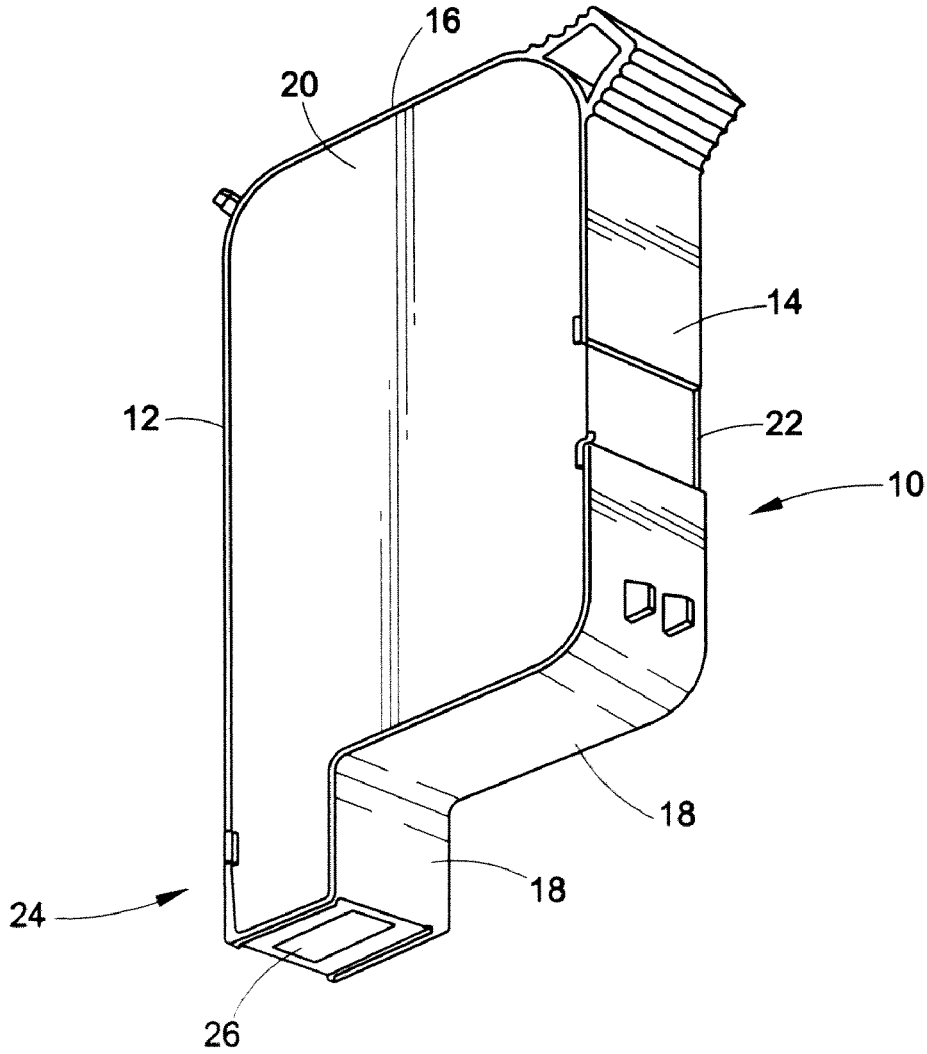
FIG. 1 is a perspective view of an ink jet cartridge to be prepared for renovation in accordance with the present invention.

Referring now in greater detail to the drawings, wherein the showings are for the purpose of illustrating preferred embodiments of the invention only and not for the purpose of limiting the invention, FIG. 1 illustrates an ink jet cartridge 10 having a front wall 12, a rear wall 14, a top wall 16, a bottom wall 18, and opposite side walls 20 and 22, all of which cooperatively define a snout region 24 at the lower front end of the cartridge. Snout 24 is provided in a well-known manner with a print head portion of the cartridge including a nozzle plate 26.

Figure 2:
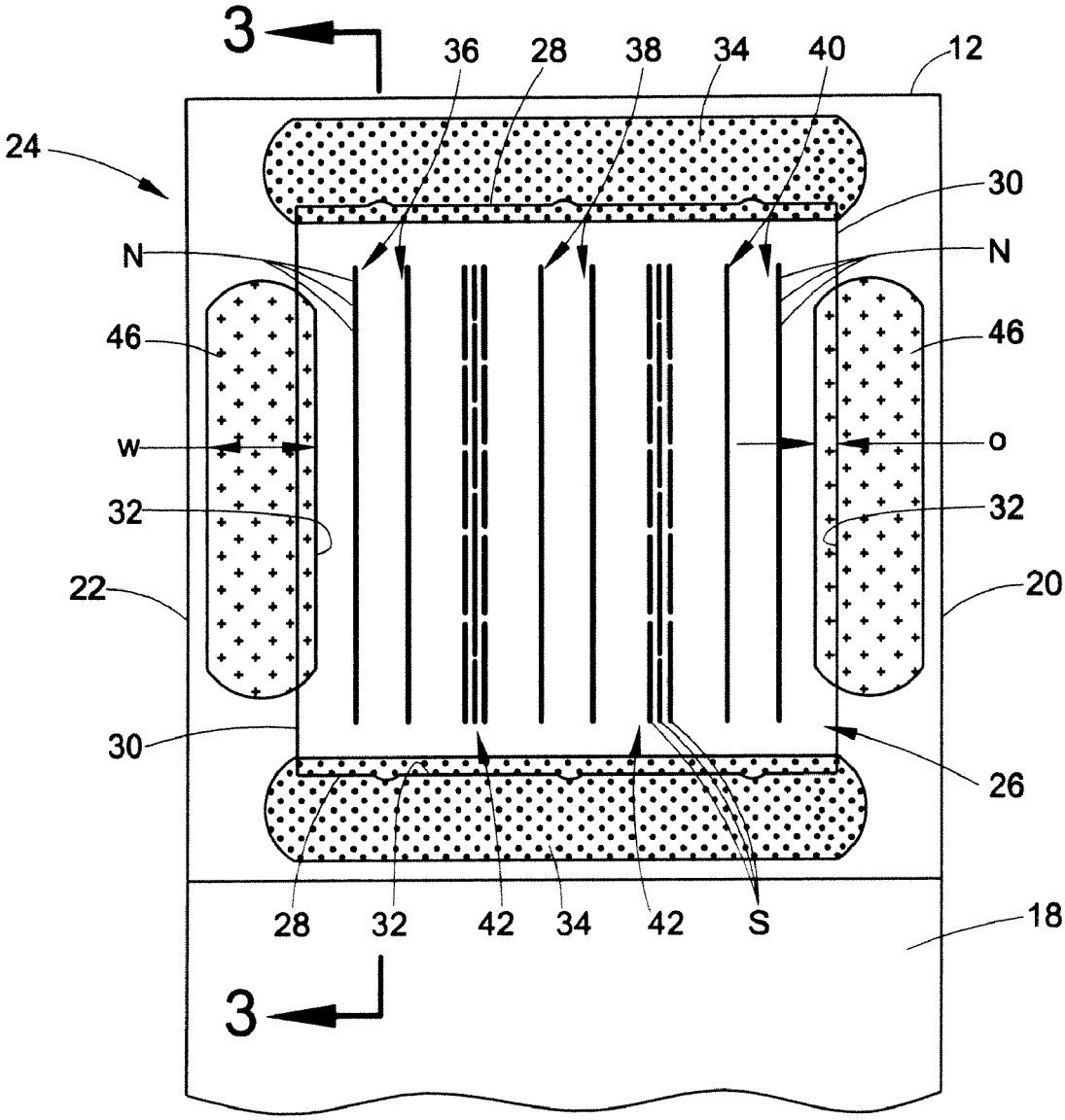
FIG. 2 is a plan view of the nozzle plate of the cartridge showing one embodiment of reinforcing adhesive beads in accordance with the invention.
Figure 3:
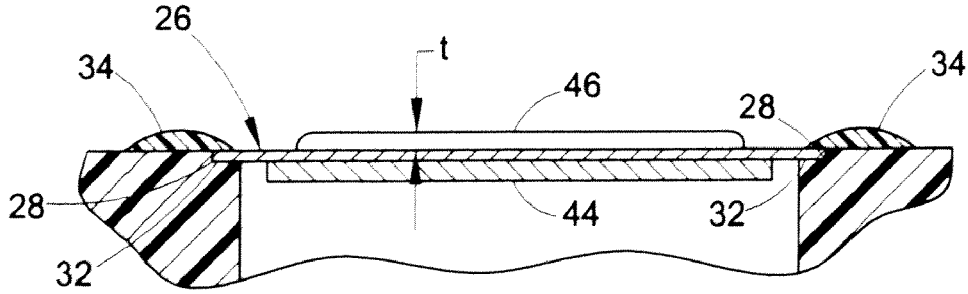
FIG. 3 is a cross-sectional elevation view taken along line 3-3 in FIG. 2.

As best seen in FIGS. 2 and 3, nozzle plate 26 has opposed pairs of side edges 28 and 30 and is received in a recess 32 in snout portion 24 and, in connection with the initial manufacturing of the cartridge, is secured in the recess by beads 34 of adhesive material extending along and overlying edges 28 of the plate. In the embodiments illustrated herein, the nozzle plate is that of a Hewllet-Packard cartridge HP1823 which includes pairs of rows 36, 38 and 40 of nozzles N extending in the direction between side edges 28 of the nozzle plate and spaced apart from one another in the direction between side edges 30 of the plate. The nozzle plate further includes two pairs of rows 42 of slot S one of which is between and parallel to rows 36 and 38 of the nozzles and the other of which is between and parallel to rows 38 and 40 of the nozzles. In each of the rows 42, slots S are offset relative to one another in the direction between side edges 28 of the nozzle plate, and the rows of slots overlie a substrate 44 of the print head.

While the invention is illustrated in connection with the cartridge HP 1823 it is applicable to other cartridges including, by way of example only, Hewllet-Packard cartridges HP 6626, HP 6578 and HP 1649A.

Figure 4:
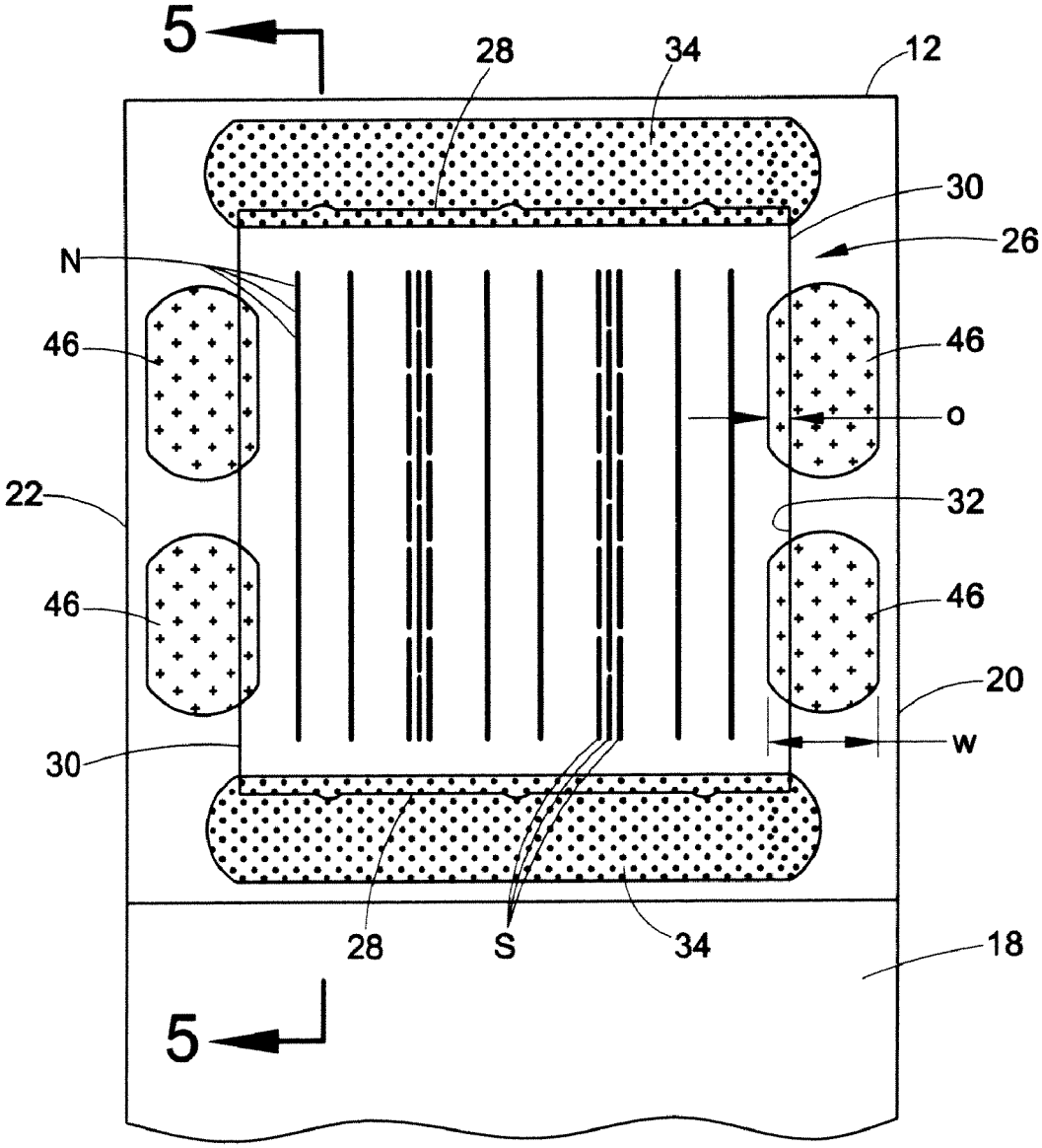
FIG. 4 is a plan view of the nozzle plate showing another embodiment of reinforcing adhesive bead placement in accordance with the invention.
Figure 5:
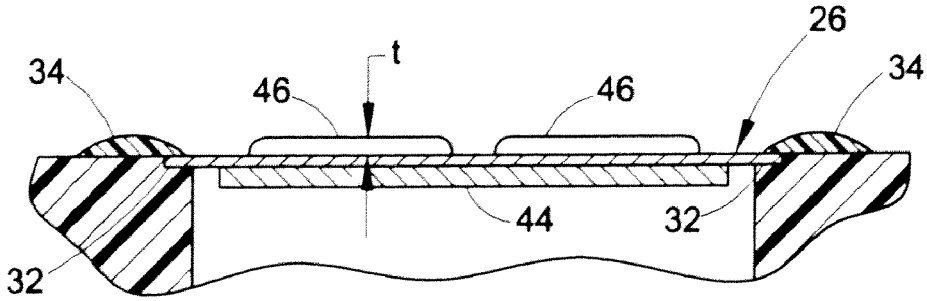
FIG. 5 is a cross-sectional elevation view taken along line 5-5 in FIG. 4.

In accordance with one aspect of the present invention, prior to the renovating process the nozzle plate is wiped with a suitable cleaning solution to remove any dried ink therefrom, and reinforcing beads 46 of adhesive material are applied along side edges 32 of the nozzle plate. Beads 46 have a width w and a thickness t, and the beads are applied to have an overlap o inwardly of the corresponding side edge 30 of the nozzle plate. In the embodiment illustrated in FIGS. 4 and 5 of the drawing, two reinforcing beads 46 of the adhesive material are applied along each of the side edges 30. The adhesive material of beads 46 penetrates downwardly between side edges 30 of the nozzle plate and the corresponding edge of recess 32.

Figure 6:
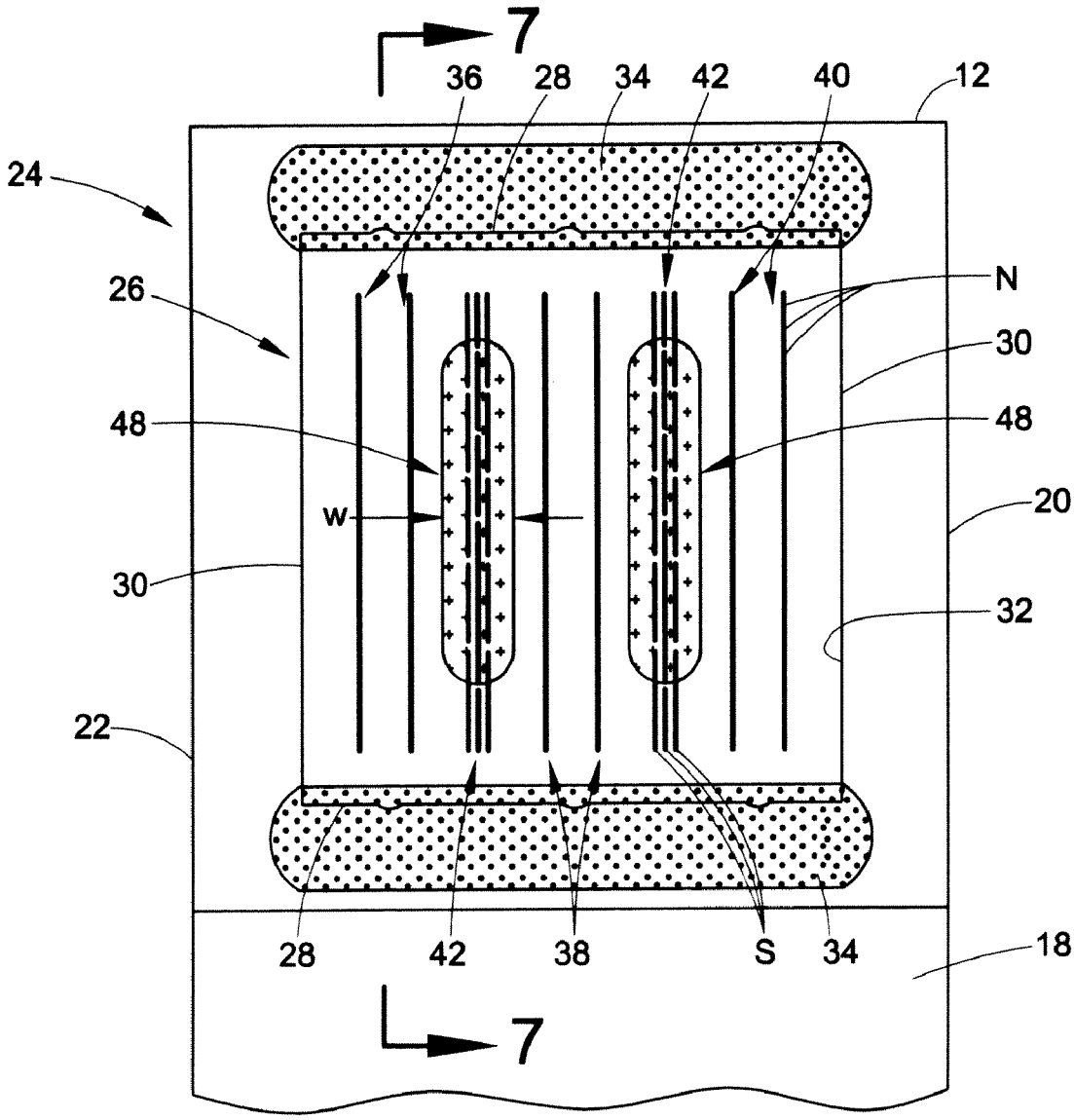
FIG. 6 is a plan view of the nozzle plate showing yet another embodiment of reinforcing adhesive bead application in accordance with the invention.
Figure 7:
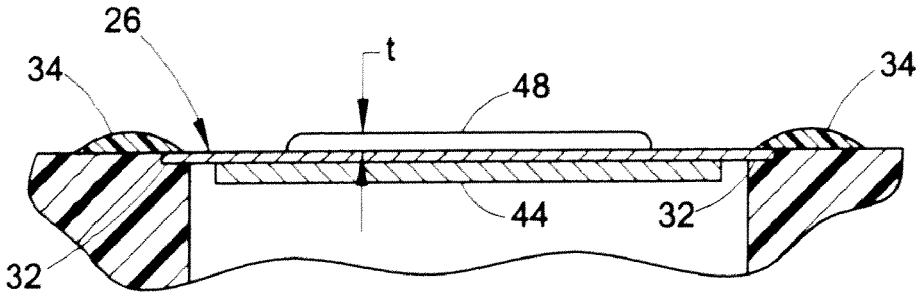
FIG. 7 is a cross-sectional elevation view taken along line 7-7 in FIG. 6.
Figure 8:
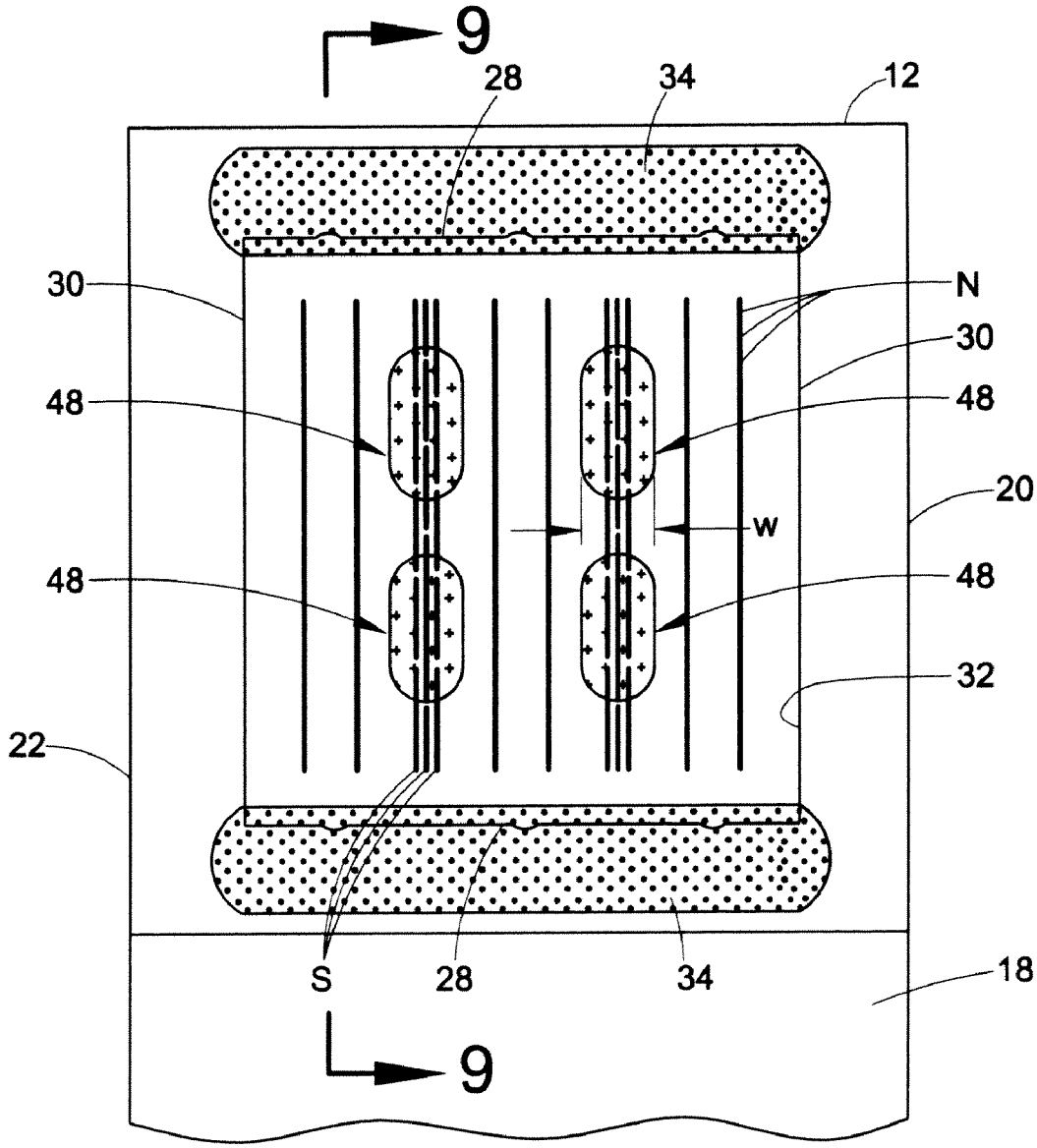
FIG. 8 is a plan view of the nozzle plate showing still another embodiment of reinforcing bead placement in accordance with the invention.
Figure 9:
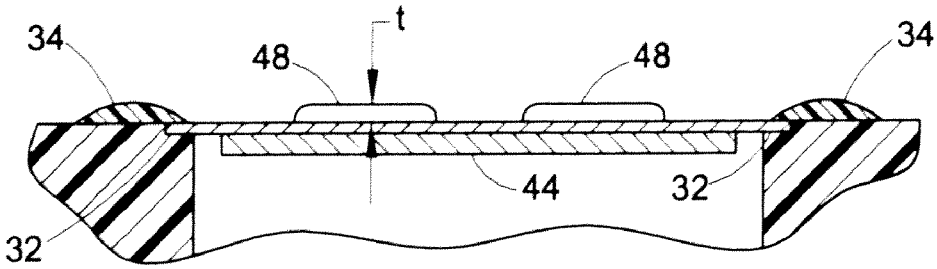
FIG. 9 is a cross-sectional elevation view taken along line 9-9 in FIG. 8.

In the embodiment illustrated in FIGS. 6 and 7 of the drawing, a bead 48 of adhesive material is applied over and along each of the rows 42 of slots S and which beads, as set forth more fully hereinafter, penetrate slots S so as to adhere to silicon chip substrate 44 beneath the nozzle plate. As with beads 46 described hereinabove, each of the beads 48 has a width w and a thickness t. In the embodiment illustrated in FIGS. 8 and 9, two reinforcing beads 48 of adhesive material are applied over each of the rows of slots.

In the embodiments disclosed herein, a preferred adhesive material for the reinforcing beads is available from Henkel Technologies under the latter's product designation Loctite 3321. The latter adhesive is a UV cured acryoated urethane. With respect to beads 46, the adhesive preferably has a viscosity of from 500 to 6,000 cP, and with respect to beads 48, the adhesive preferably has a viscosity of from 1 to 150 cP. With respect to adhesive beads 46, width w is 1.400 mm, thickness t is 0.250 mm, and overlap o is 0.250 mm. With regard to adhesive beads 48, width w is 0.900 mm, and thickness t is 0.250 mm.

Preferably, with regard to the beads of adhesive applied along side edges 30 and over slots S of the nozzle plate, the glue is deposited at a pressure of between 12 and 15 psi. This pressure promotes dispensing of the glue into the area between the recess and plate edge and downwardly through the slots so as to adhere to the silicon chip therebelow.

While it is possible to manually apply the adhesive in the patterns described hereinabove, it is preferred to apply the glue through the use of robotic apparatus which is programmable to deposit the various patterns at the desired pressure and with the preferred dimensions. In particular in this respect, the use of such apparatus provides accuracy with respect to bead location and height and consistency of deposit from one cartridge to the next. Accordingly, process efficiency is realized with minimal material waste and product costs are advantageously reduced.

Figure 10:
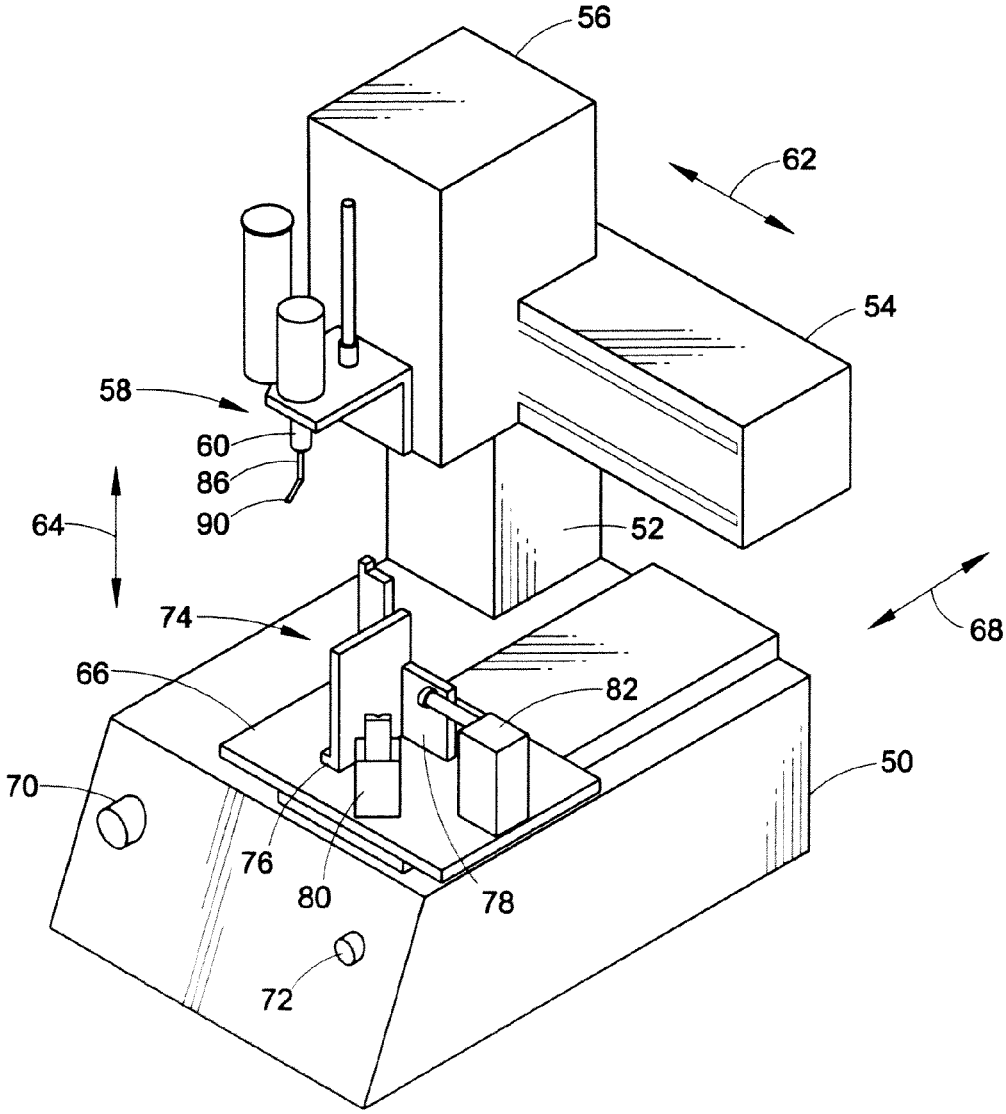
FIG. 10 is a perspective view of apparatus for applying beads of adhesive material to a cartridge in accordance with the invention.
Figure 13:
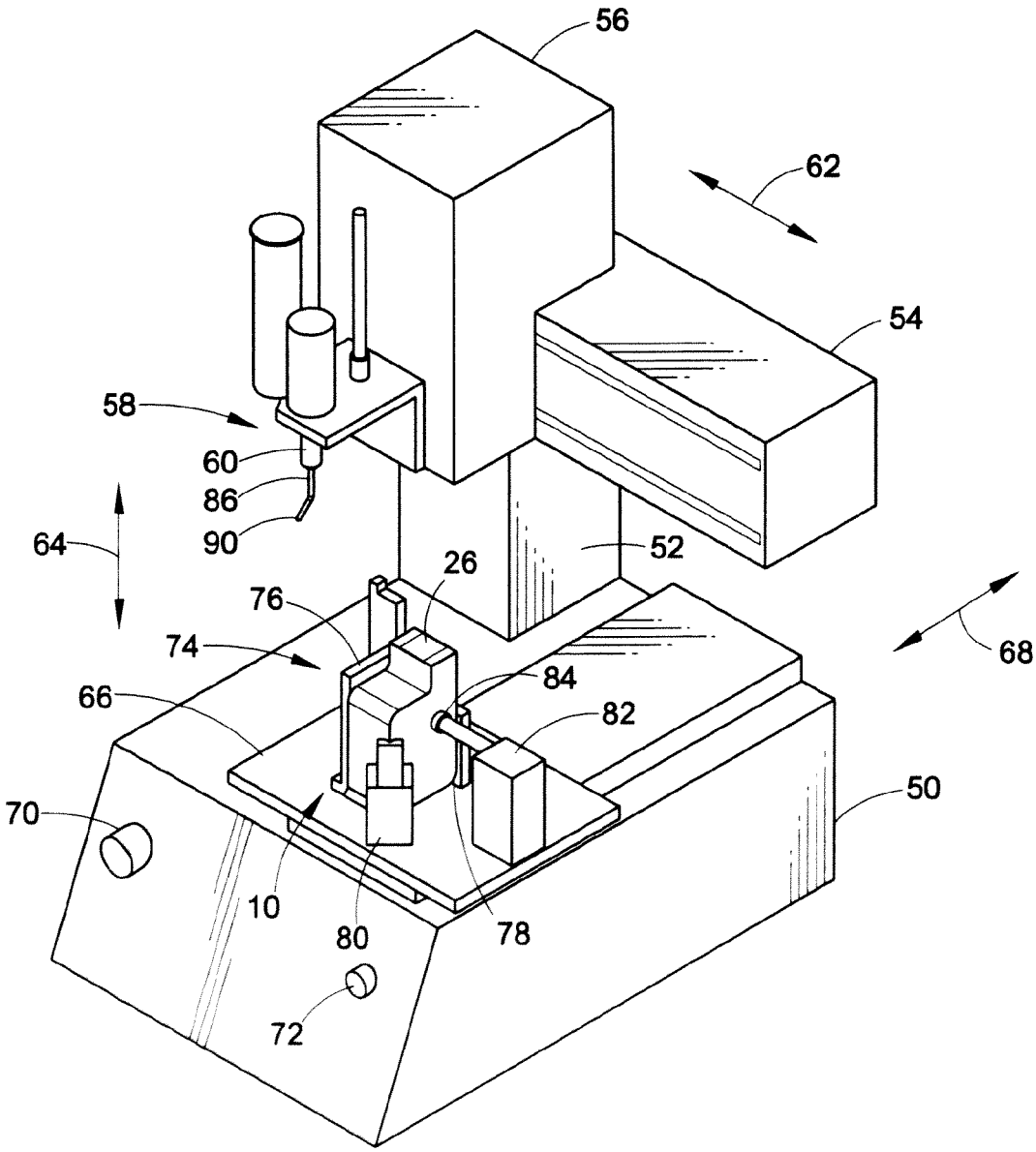
FIG. 13 is a perspective view of the apparatus showing a cartridge mounted thereon for receiving beads of glue; and, FIG. 14 is a perspective view of apparatus supporting a plurality of cartridges to receive the glue in accordance with the invention.
Figure 14:
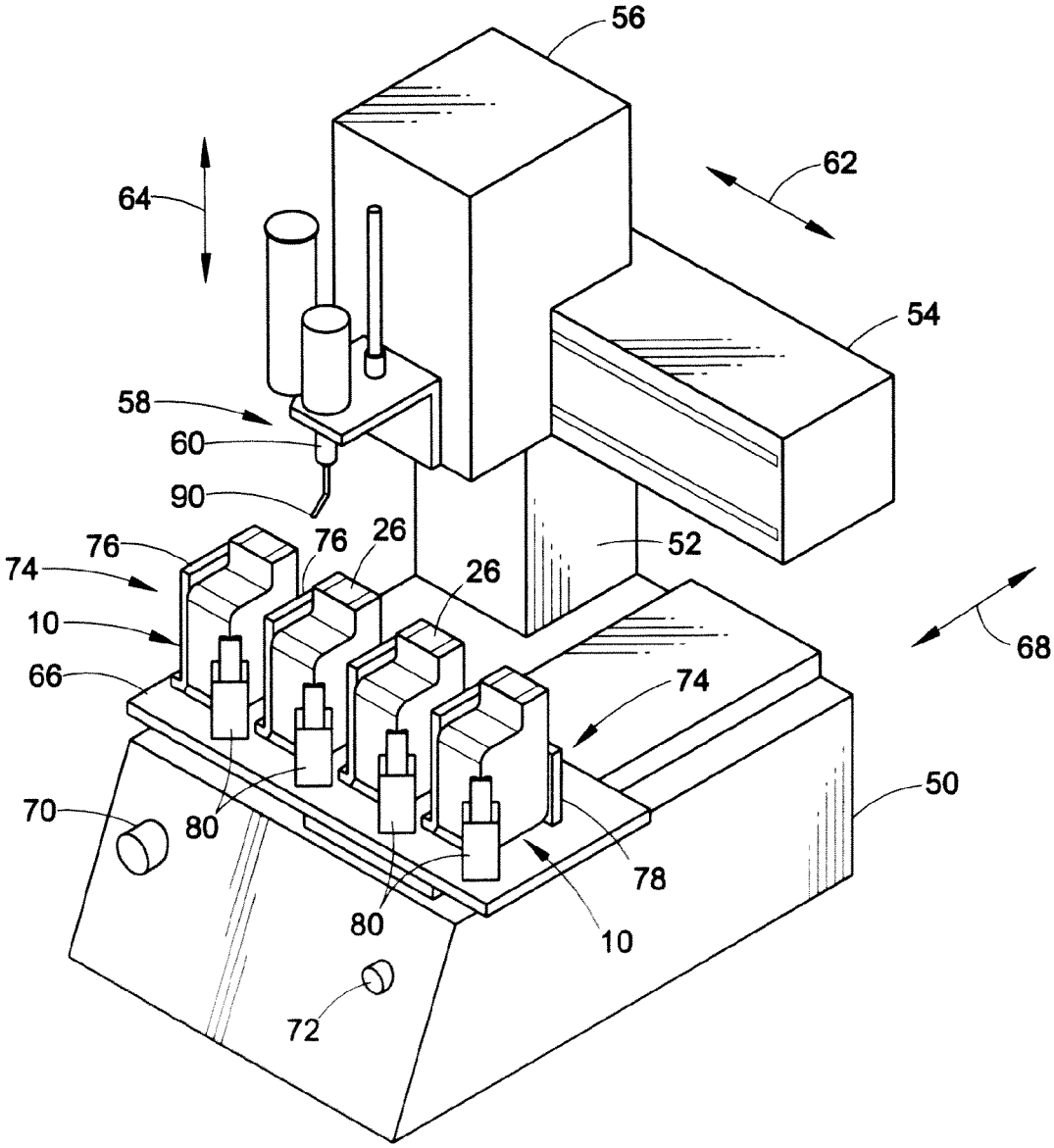

Robotic glue dispensing apparatus for the foregoing purpose is illustrated in FIGS. 10, 13 and 14 of the drawing and is available from Henkel Technologies under the latter's product designation 98279. Loctite 203. Bench Top Robot. Briefly, the apparatus includes a base 50 and a track post 52 extending upwardly therefrom and supporting a horizontally extending track member 54. Track member 54 supports a carriage 56 for a glue dispensing nozzle assembly 58 which includes a glue dispensing nozzle or needle 60. Carriage 56 is displaceable horizontally along track 54 and in opposite directions as indicated by arrow 62, and nozzle assembly 58 is displaceable vertically relative to carriage 56 and in opposite directions as indicated by arrow 64. Base 50 is provided with a workpiece support table 66 which is displaceable horizontally in opposite directions as indicated by arrow 68 and which direction is perpendicular to that represented by arrow 62. Base 50 is provided with an on/off switch 70 by which programmed operation of the apparatus is initiated, and a kill switch 72 enables stopping the operation should it become necessary or desirable to do so.

In accordance with another aspect of the present invention, table 66 is provided with a cartridge clamping assembly 74 which, as shown in FIG. 13, is operable to mount a cartridge 10 on the table for displacement therewith and with nozzle plate 26 facing upwardly. In this respect, clamping assembly 74 includes a plate 76 against which side 22 of the cartridges engage, and a plate 78 at right angles to plate 76 for engaging front wall 12 of the cartridge. Plates 76 and 78 provide a corner into which the cartridge is pressed by an angularly-oriented spring-loaded clamping member 80 having a V-shaped nose portion, not designated numerically, for engaging the corner between rear wall 14 and side wall 20 of the cartridge so as to bias the cartridge into the corner between plates 76 and 78. Preferably, the clamping assembly further includes a spring-loaded, toggle-type clamping member 82 having a resilient nose portion 84 for engaging side wall 20 of the cartridge. This clamping member is perpendicular to plate 76 and biases the cartridge thereagainst. As will be appreciated from the foregoing description, a cartridge 10 is firmly clamped in place on table plate 66 and on/off switch 70 is actuated to initiate displacements of table 66, carriage 56 and nozzle assembly 58 for the application of beads of adhesive to the nozzle plate of the cartridge in accordance with the programmed glue pattern. When the program is completed, the apparatus turns off and the cartridge is removed therefrom.

Figure 11:
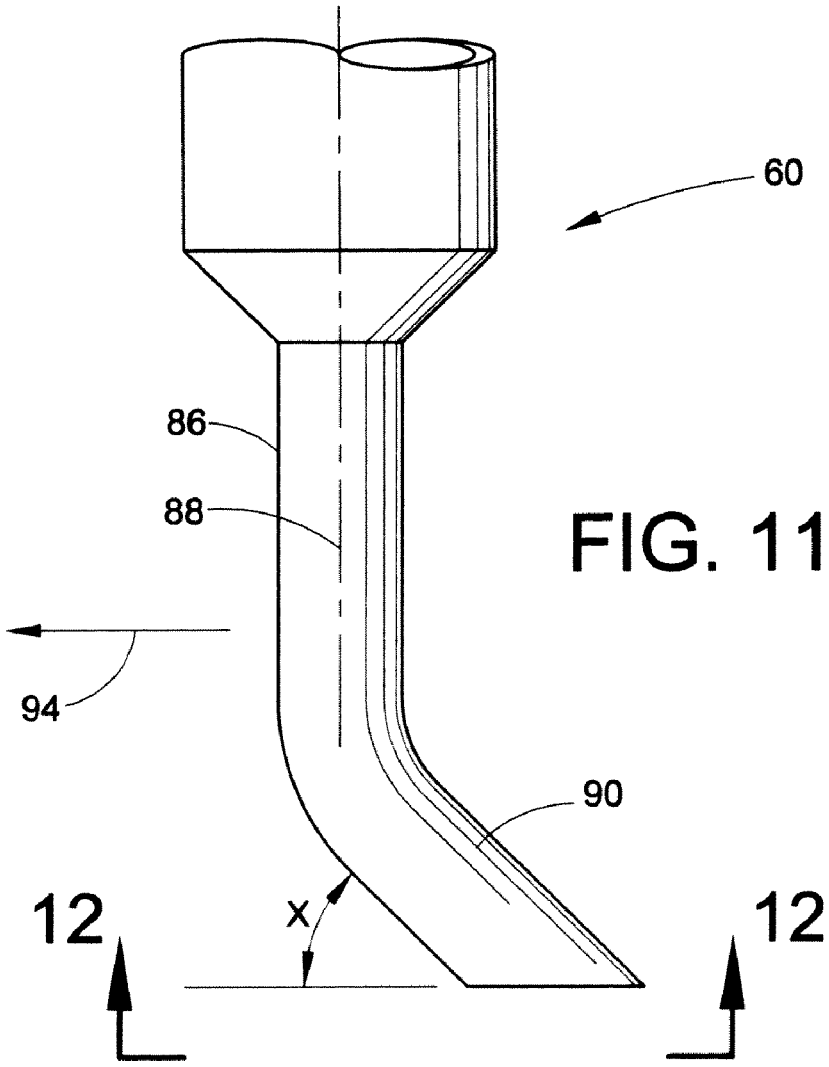
FIG. 11 is an enlarged view of a portion of the adhesive dispensing needle for the apparatus.
Figure 12:
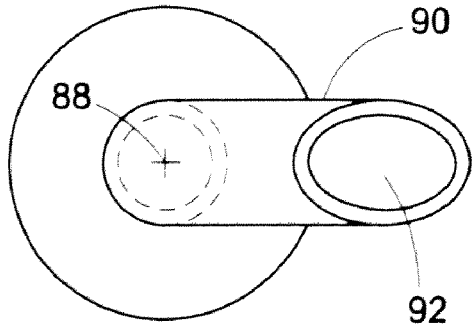
FIG. 12 is a view of the outlet end of the needle taken along line 12-12 in FIG. 11.

In accordance with yet another aspect of the invention, as shown in FIGS. 11 and 12 of the drawing, the glue dispensing nozzle or needle 60 includes a circular stem portion 86 having a vertical axis 88 when mounted in the glue dispensing assembly and a terminal end 90 at an angle x to horizontal. The terminal end is provided with an outlet opening 92 which is in a horizontal plane and, accordingly, has an oval contour. Preferably, angle x is 45°. During the depositing of glue, the needle moves relative to a nozzle plate in the direction of arrow 94, and the oval or ellipsoidal contour of the needle allows the continuous flow of glue so as to maintain a straight line edge of a glue bead onto the nozzle plate. The oval contour also enables the bead of adhesive to be drawn along the surface to which it is applied rather than being plowed along the surface as would be the case if the outlet opening was at an angle to the nozzle plate as opposed to being parallel thereto. Still further, the needle tip contour promotes accuracy with respect to the glue bead overlap of the side edge of the nozzle plate as well as accuracy with respect to maintaining the desired width and thickness of the adhesive feed.

FIG. 14 illustrates a modification of the workpiece support plate 66 of the apparatus for the latter to accommodate a plurality of cartridge clamping assemblies 74 as described hereinabove in connection with FIGS. 10 and 13. It will be appreciated of course that the apparatus in this instance is programmed to apply a preselected adhesive bead pattern to each of the plurality of cartridges during a cycle of operation of the apparatus.

While considerable emphasis has been placed herein on preferred embodiments of the invention, it will be appreciated that other embodiments can be made and that many changes can be made in the preferred embodiments without departing from the principles of the invention. Accordingly, it is to be distinctly understood that the foregoing descriptive matter is to be interpreted merely as illustrative of the invention and not as a limitation and that it is intended to include other embodiments and all modifications of the preferred embodiments insofar as they come within the scope of the appended claims or the equivalents thereof.

What is claimed is:

1. An ink jet cartridge comprising: a housing having a print head portion including a nozzle plate having opposed pairs of outer side edges and rows of nozzles, said nozzle plate being attached to said head portion by a first set of beads of an adhesive material overlying the outer edges of one pair of said opposed pairs of side edges, a second set of beads of an adhesive material overlying the other pair of said opposed pairs of outer side edges, wherein each of said first set and second set of beads have an overlap inwardly of a corresponding outer side edge of said nozzle plate and said first and second set of beads penetrate downwardly between corresponding outer edges of said nozzle plate.

2. The ink jet cartridge according to claim 1, wherein said beads includes at least a single bead of said adhesive material overlying each edge of said other pair of edges between said one pair of opposed edges.

3. The ink jet cartridge according to claim 2, wherein each bead of adhesive has a thickness of 0.250 mm.

4. The ink jet cartridge according to claim 2, wherein each bead overlies the corresponding edge 0.250 mm.

5. The ink jet cartridge according to claim 4, wherein each bead of adhesive has a thickness of 0.250 mm.

6. The ink jet cartridge according to claim 1, wherein said second set of beads includes a plurality of beads of said adhesive material overlying each edge of said other pair of edges between said one pair of opposed edges.

7. The ink jet cartridge according to claim 6, wherein each of said plurality of beads has a thickness of 0.250 mm.

8. The ink jet cartridge according to claim 6, wherein each of said plurality of beads overlies the corresponding edge 0.250 mm.

9. The ink jet cartridge according to claim 8, wherein each of said plurality of beads has a thickness of 0.250 mm.

10. An ink jet cartridge comprising: a housing having a print head portion including a nozzle plate having opposed pairs of side edges, rows of nozzles and at least one row of slots between said rows of nozzles, said nozzle plate being attached to said head portion by a first set of beads of an adhesive material overlying the edges of one pair of said opposed pairs of side edges, and a second set of beads including a reinforcing bead of an adhesive material overlying at least one of the other pair of said opposed pairs of side edges and covering at least one row of slots.

11. The ink jet cartridge according to claim 10, wherein the reinforcing bead overlies said at least one row of slots.

12. The ink jet cartridge according to claim 11, wherein said reinforcing bead includes a single bead of said adhesive material overlying said at least one row of slots.

13. The ink jet cartridge according to claim 12, wherein said single bead has a thickness of 0.250 mm.

14. The ink jet cartridge according to claim 11, wherein said reinforcing bead includes a plurality of beads of said adhesive overlying said at least one row of slots.

15. The ink jet cartridge according to claim 14, wherein each of said plurality of beads has a thickness of 0.250 mm.

16. A method of preparing an ink jet cartridge for renovation, said cartridge having a housing including a print head portion and a nozzle plate adhered to the print head portion by a first set of beads of an adhesive material along one pair of two pairs of opposed side edges of the nozzle plate, said method including applying a second set of beads of an adhesive material to overlie the other of the two pairs of opposed side edges of the nozzle plate wherein each of said first set and said second set of beads have an overlap inwardly of a corresponding edge of outer edge of said nozzle plate, and said first and second set of beads penetrate downwardly between corresponding edges of said nozzle plate.

17. The method according to claim 16, and applying the second set of beads as at least a single bead overlying each edge of said other of the two pairs of opposed side edges.

18. The method according to claim 17, and applying each bead to have a thickness of 0.250 mm.

19. The method according to claim 17, and applying each bead to overlie the corresponding edge 0.250 mm.

20. The method according to claim 16, and applying the reinforcing bead as a plurality of beads overlying each edge of said other of the two pairs of opposed side edges.

21. The method according to claim 20, and applying each of said plurality of beads to have a thickness of 0.250 mm.

22. The method according to claim 20, and applying each of said plurality of beads to overlie the corresponding edge 0.250 mm.

23. The method according to claim 16, wherein the adhesive has a viscosity of from 500 to 6000 cp.

24. The method according to claim 16, and applying the adhesive at a pressure of from 12 to 15 psi.

25. A method of preparing an ink jet cartridge for renovation, said cartridge having a housing including a print head portion and a nozzle plate adhered to the print head portion by a first set of beads of an adhesive material along one pair of two pairs of opposed side edges of the nozzle plate, said nozzle plate having at least one row of slots between said rows of nozzles, said method including applying a second set of reinforcing beads of an adhesive material to overlie at least one of the other of the two pairs of opposed side edges of the nozzle plate and to cover said at least one row of slots.

26. The method according to claim 25, and applying the reinforcing beads to overlie said at least one row of slots.

27. The method according to claim 26, and applying the second set of reinforcing beads as at least a single bead overlying said at least one row of slots.

28. The method according to claim 27, and applying said single bead to have a thickness of 0.250 mm.

29. The method according to claim 26, and applying the reinforcing bead as a plurality of beads overlying said at least one row or slots.

30. The method according to claim 29, and applying each of said plurality of beads to have a thickness of 0.250 mm.

31. The method according to claim 26, wherein said adhesive has a viscosity of from 1 to 150 cp.

32. The method according to claim 25, and applying the adhesive at a pressure of from 12 to 15 psi.

* * * * *